US007836657B1

(12) United States Patent
diGirolamo et al.

(10) Patent No.: US 7,836,657 B1
(45) Date of Patent: Nov. 23, 2010

(54) METAL STUD AND BRIDGING MEMBER FOR STUD

(75) Inventors: Edward R. diGirolamo, Raleigh, NC (US); Michael Torres, Raleigh, NC (US); Thomas Trestain, Toronto (CA)

(73) Assignee: The Steel Network, Inc., Raleigh, NC (US)

( * ) Notice: Subject to any disclaimer, the term of this patent is extended or adjusted under 35 U.S.C. 154(b) by 0 days.

(21) Appl. No.: 12/353,595

(22) Filed: Jan. 14, 2009

Related U.S. Application Data

(63) Continuation of application No. 10/910,114, filed on Aug. 3, 2004.

(51) Int. Cl.
*E04B 1/38* (2006.01)

(52) U.S. Cl. ..... 52/712; 52/317; 52/696; 52/836

(58) Field of Classification Search ..... 52/317, 52/653.1, 655, 656.1, 696, 731.9, 720, 730, 52/481.1, 836, 703, 712
See application file for complete search history.

(56) References Cited

U.S. PATENT DOCUMENTS 3,778,952 A * 12/1973 Soucy ..... 52/667
4,007,570 A 2/1977 Hunter
4,791,766 A * 12/1988 Egri, II ..... 52/317
4,840,005 A 6/1989 Cochrane
5,157,883 A 10/1992 Meyer
5,943,838 A 8/1999 Madsen et al.
5,964,071 A 10/1999 Sato
6,164,028 A 12/2000 Hughes
6,199,336 B1 3/2001 Poliquin
6,694,695 B2 2/2004 Collins et al.
6,701,689 B2 3/2004 diGirolamo
2003/0089053 A1 5/2003 Elderson

* cited by examiner

*Primary Examiner*—Richard E Chilcot, Jr.
*Assistant Examiner*—William V Gilbert
(74) *Attorney, Agent, or Firm*—Coats & Bennett, P.L.L.C.

(57) ABSTRACT

A combination stud and bridging member for use in a metal wall. The stud includes a web and a pair of flanges with the web including first and second sides and having a depression formed therein. Adapted to engage or extend through the web, the bridging member includes first and second end portions. One end portion includes a concave shaped recess that when disposed adjacent the stud accommodates the depression formed in the web. Disposed on the end portion of the bridging member having the concave recess is a projection receiver. Disposed on the opposite end of the bridging member is a projection. In a wall structure, the bridging members are adapted to extend between the studs. More particularly, the projections of the bridging members extend through openings formed in the web of the studs and into the projection receivers of adjacent bridging members to form an interlocked relationship.

10 Claims, 8 Drawing Sheets

METAL STUD AND BRIDGING MEMBER FOR STUD

CROSS REFERENCE TO RELATED APPLICATIONS

This is a continuation of U.S. patent application Ser. No. 10/910,114 filed Aug. 3, 2004. The disclosure of this patent application is incorporated herein by reference.

BACKGROUND OF THE INVENTION

Light gauge metal studs have long been used in non-load bearing walls in commercial buildings. Generally these non-load bearing metal studs are of a basic C-shaped or channel construction. There are many advantages to using metal studs in wall structures. They form straight and true walls and allow for rapid construction. Generally speaking there are other advantages to using metal studs. These include durability, resistance to fire and termites and because metal studs are dimensionally stable they will not expand or contract with humidity changes.

In the past load bearing metal studs have been used but they have not been used to the extent of non-load bearing metal studs. However, there are also advantages to be gained from utilizing load bearing metal studs. Costs are generally lower than with other traditional methods of construction such as masonry, steel, precast and concrete. Load bearing metal studs can be efficiently erected even in poor weather conditions. Like the advantages in non-load bearing walls, metal studs in load bearing walls form straight and true wall structures and can be erected quickly.

Conventional channel shaped metal studs, such as those used in non-load bearing applications, are not as structurally efficient for load bearing applications where substantial bearing loads must be carried. Load bearing studs carry vertical floor and roof loads from above in addition to horizontal loads due to wind and other forces along the stud length. Non-load bearing studs carry horizontal loads due to wind and other forces along the stud length. Significant amounts of steel in conventional channel shaped studs are ineffective for load carrying purposes. For example, in a conventional channel shaped stud, the intermediate portion of the web carries less of the total axial load than comparable size outer sections of the web. Thus the strength to weight ratio of the stud is said to be relatively low.

Additional strength can be imparted to wall sections and the metal studs thereof by providing bridging members that extend between the respective studs. Typically bridging members are fastened to the studs in a variety of ways. For example, cold roll channel has long been used to bridge metal studs. The cold roll channel is extended through knockout openings in the respective studs and can be actually secured to the studs by clips, weldment or other suitable means. When used, bridging members provide additional structural strength to the wall that tends to prevent the individual studs from twisting under load and further, provides additional strength that keeps the individual studs from buckling.

One of the challenges in metal wall design that calls for substantial strength and bridging members, is to provide a stud and bridging member design that is compatible. That is, it is beneficial for the studs and bridging members to work together to provide ample structural integrity and strength. In this regard the design of the bridging member must be such that it can be installed in a practical and economical way. This challenge can be made more difficult when the design of the stud departs from conventional practice.

Therefore, there is a need for a strong and sturdy stud design as well as a bridging member design that is compatible.

SUMMARY OF THE INVENTION

The present invention relates to a bridging member for interconnecting two metal studs. The bridging member includes a main member having first and second sections. A projection extends from at least one end portion of the main member and which is adapted to connect to or interlock with a portion of another bridging member.

Another aspect of the present invention entails a combination stud and bridging member. Here the stud includes a web and a pair of flanges with the web having first and second sides and a depression formed therein. The bridging member includes first and second end portions with the first end portion being configured to terminate adjacent the first side of one web and with the second end portion being configured to terminate adjacent the second side of another web. In order to be compatible with the stud, the first end portion of the bridging member includes a recess and when associated with the stud the depression of the web projects into the recess.

In another aspect of the present invention, the combination stud and bridging member is incorporated into a wall structure to form a wall structure having a series of studs and a series of bridging members interconnected between the studs. In this case, the respective studs include a web and a pair of flanges with the web including first and second sides and having a depression formed therein. The plurality of bridging members extend between respective studs of the metal wall structure with each bridging member including first and second end portions. One end portion of the respective bridging members includes a recess and wherein the depression of the respective studs project into the recesses of adjacent bridging members.

DETAILED DESCRIPTION OF THE INVENTION

Figure 10:
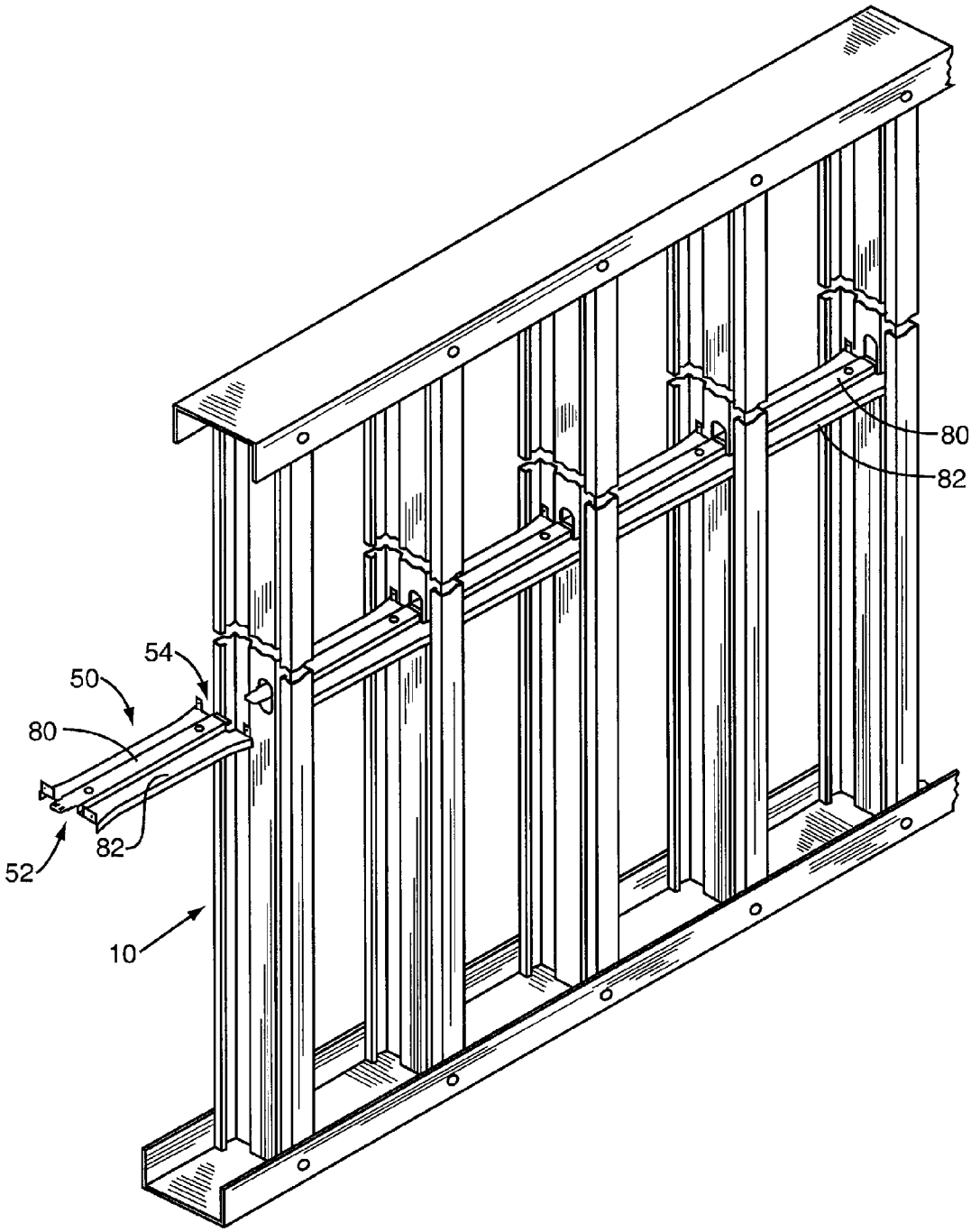
FIG. 10 is a fragmentary perspective view of a wall structure incorporating the stud and bridging member of the present invention.

With further reference to the drawings, a stud is shown therein and indicated generally by the numeral 10. In addition, a bridging member is shown therein and indicated generally by the numeral 50. In one embodiment, the stud 10 and bridging member 50 are designed to be used together in a metal stud wall such as illustrated in FIG. 10. As can be seen therein, the metal stud wall includes a series of spaced apart studs 10 and a series of bridging members 50. Bridging members 50 are interconnected between the respective studs 10. Details of how the respective bridging members 50 interconnect and extend between the respective studs 10 will be dealt with subsequently herein.

Before discussing the bridging member 50 and how the bridging member is utilized in the metal wall structure of FIG. 10, a discussion of the stud 10 will be presented. Metal stud 10 is of an open construction and basically comprises a web indicated generally by the numeral 12 and a pair of opposed flanges indicated generally by the numeral 14. By open construction it is meant that the metal stud 10 is not closed but includes an opening formed in the back of the stud.

Figure 1:
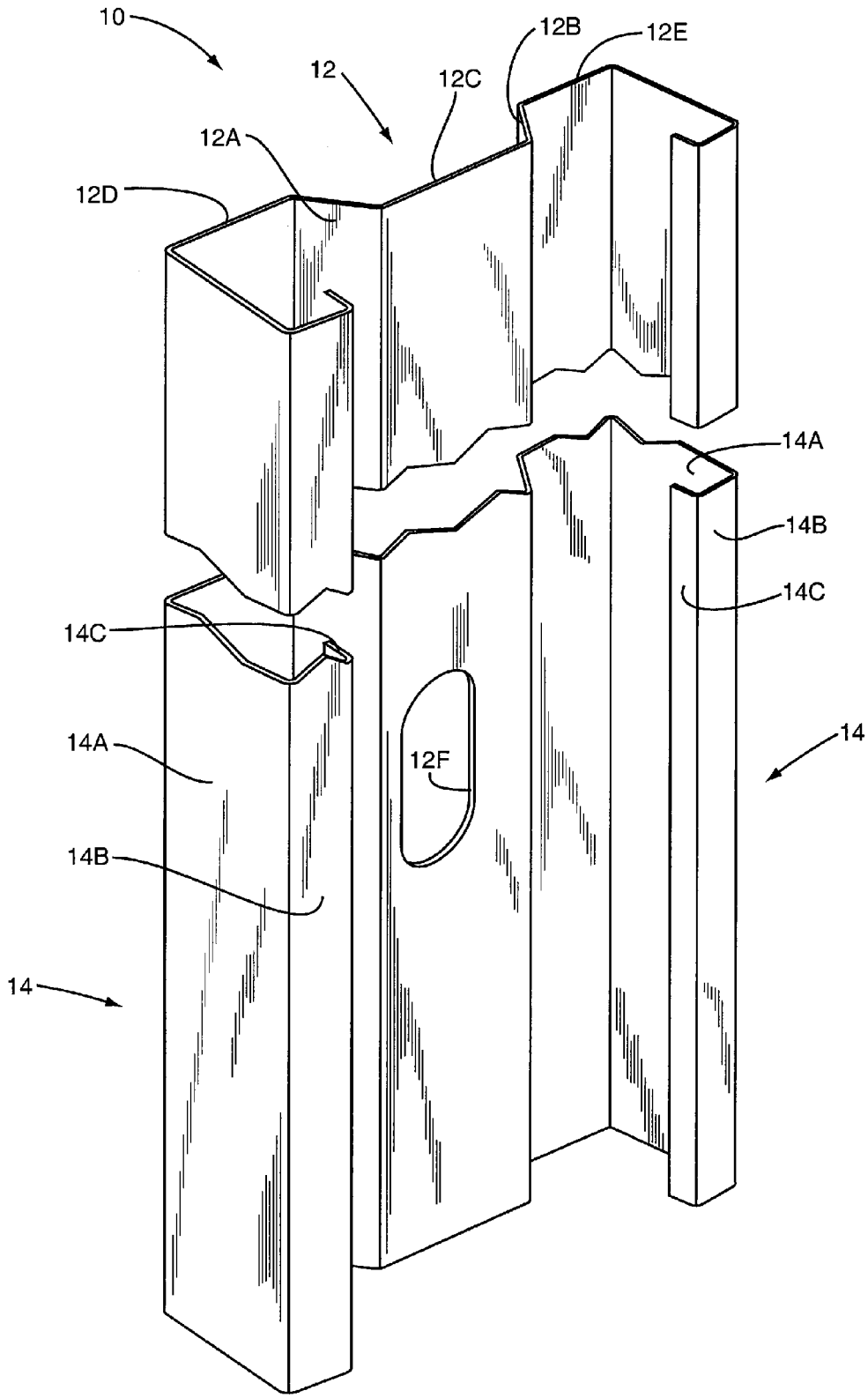
FIG. 1 is a fragmentary perspective view of the stud of the present invention.
Figure 2:
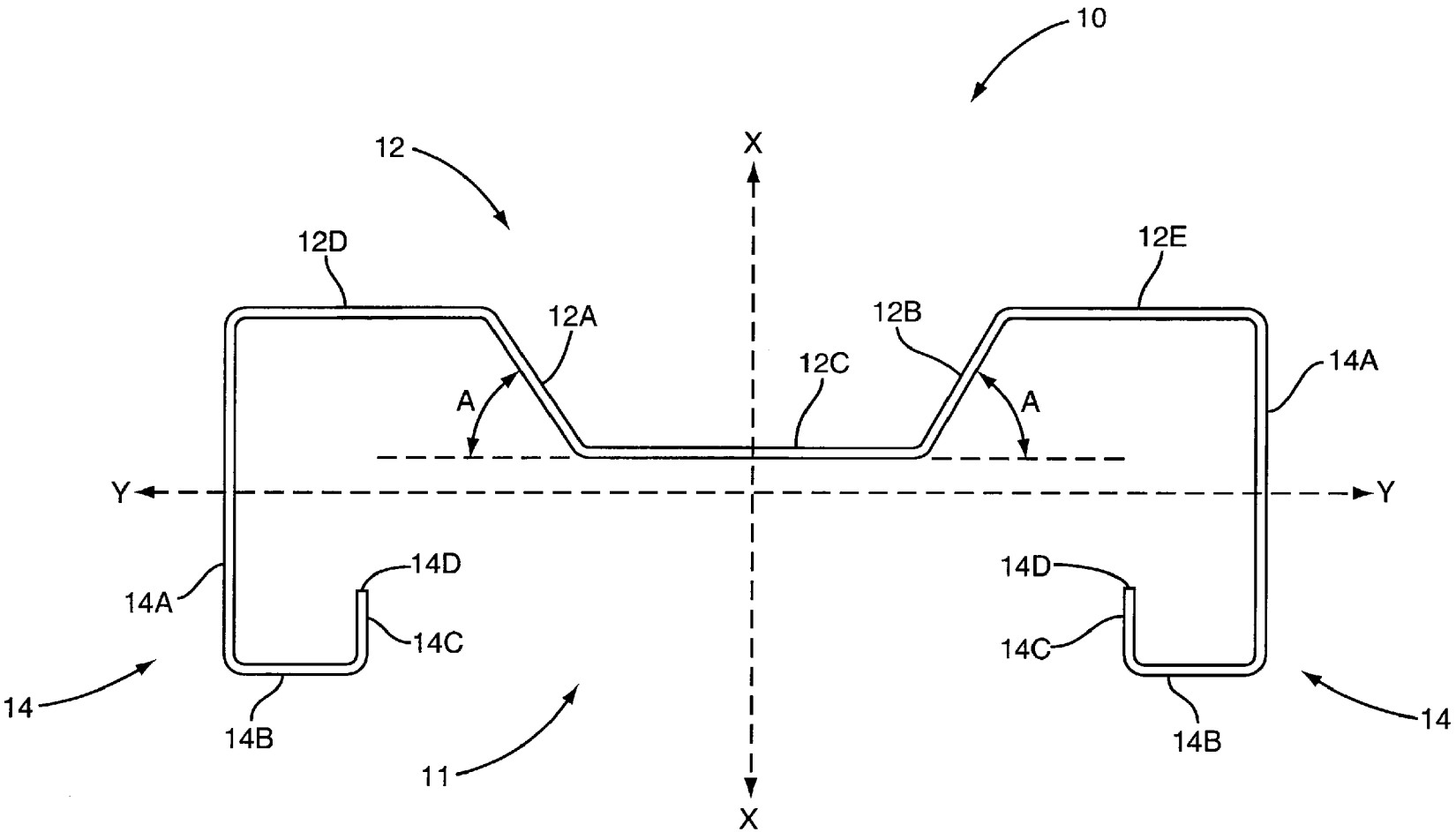
FIG. 2 is an end view of the stud.

First, with respect to the flanges, each flange 14 is of a generally J-shape. It should be appreciated that the J-shaped configuration of the flange 14 forms a part of the particular embodiment disclosed herein but that the shape of the flange may vary. In any event, with reference to FIGS. 1, 2 and 3, flange 14 includes a side 14A. Side 14A extends from the front of the stud 10 to the back of the stud 10. Extending inwardly from the side 14A is a back or lip 14B. For purposes of reference, the backs 14B of the two flanges 14 form the back extremity of the metal stud 10. Extending from the back 14, towards the web 12, is a turned end 14C. Turned end 14C includes a terminal end 14D. Consequently, for this particular embodiment, it is seen in FIG. 2 that each flange 14 forms a generally J-shape. Further, the turned end 14C extends generally parallel with the side 14A of each flange 14.

Now turning to a discussion of the web 12, it is seen that the web extends between the two flanges 14 and for purposes of reference, the web 12 forms the front of the metal stud 10. A channel or depression is formed centrally in the web 12 and extends continuous from one end of the metal stud 10 to the other end of the metal stud. This depression includes a pair of diagonal sides or side sections 12A and 12B. Extending between the diagonal sides 12A and 12B is a section 12C that happens to be a center section in this case. Because the depression is centrally located in the web 12, there is defined a pair of outer raised surfaces or sections 12D and 12E, as viewed in FIG. 2, on opposite sides of the depression. Surfaces 12D and 12E form a part of the web 12 and in this case are coplanar. Also, each surface or section 12D or 12E, is disposed at an angle generally normal to the side 14A of the adjacent flange 14. Finally, web 14 is provided with an opening 12F to accommodate stud spacers or bridging members if desired.

As illustrated in FIG. 2 the diagonal sides 12A and 12B of the depression are disposed at an angle A with respect to a reference line that extends through the center section 12C of the depression. In this particular embodiment, angle A is approximately 37° and may vary between 15° and 89°.

From FIG. 2, it is seen that the channel or depression formed by sides 12A and 12B and the center section 12C are indented or recessed from the outer portions of the web 12 and are essentially set back into the area defined between the front and back of the stud 10. It is appreciated that the flanges 14 and particularly the sides 14A thereof tend to prevent the metal stud 10 from buckling in either direction of the reference line X. The web 12, on the other hand, and particularly the sections or surfaces thereof that extend parallel to the referenced line Y, tend to prevent the stud from buckling in either direction of the Y reference line. The sides 12A and 12B that form a part of the channel or channel depression in the web 12 also act to prevent buckling in either direction of the X reference line. This is because the diagonal sides 12A and 12B have a substantial structural component that extends parallel to the X reference line and therefore is effective to contribute to the resistance of buckling along the X reference line. Therefore, to some extent, the diagonal sides 12A and 12B are complimentary to the flanges 14 and particularly to the sides 14A of the flanges. Typically the thickness of the metal forming the stud would be in the range of 27 mils to 118 mils which equate to a gauge range of 22 to 10.

Likewise, in this case, the sides 12A and 12B have a structural component that is oriented parallel with respect to the Y reference line. Therefore, to some extent the sides 12A and 12B of the channel of the web tend to contribute to resisting buckling in either direction of the Y reference line.

Figure 3:
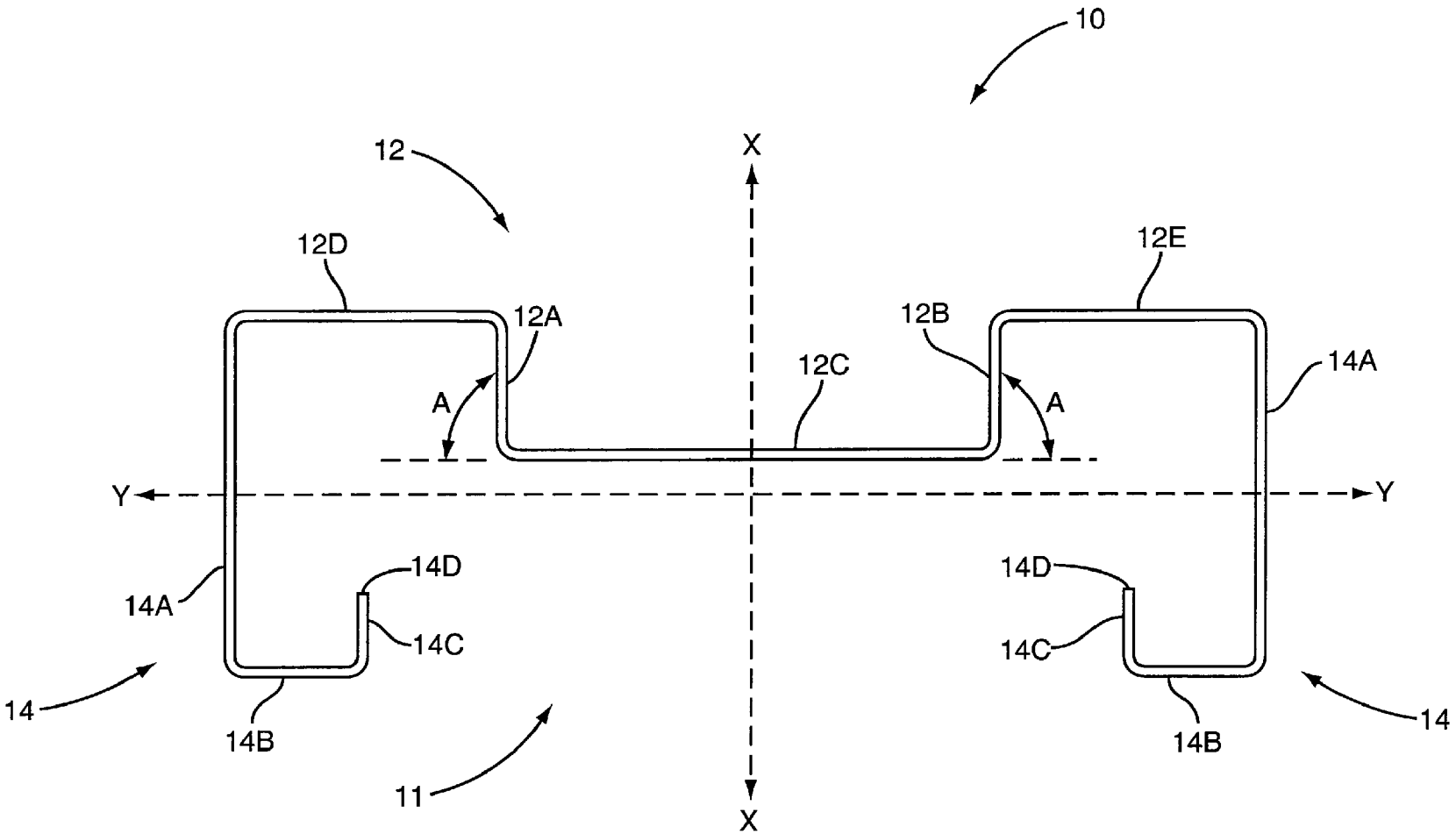
FIG. 3 is an end view of an alternate design for the stud.

FIG. 3 illustrates an alternative design for the metal stud 10. In this case the sides or side sections 12A and 12B of the channel formed in the web are not diagonally disposed. As seen in FIG. 3, each side section 12A and 12B extends generally normal to the reference line extending outwardly from the section 12C. Thus angle A in the FIG. 3 embodiment is generally 90°. Note also that the side sections 12A and 12B extend generally normal with respect to the two outer sections 12D and 12E.

Compared to a conventional C-shaped metal stud, the stud designs of FIGS. 2 and 3 are substantially more effective. Generally, the longer the individual elements or surfaces that make up the stud, the less efficient the elements become. That is, relatively long elements or surfaces of a metal stud become what is sometimes referred to as "thin" and do not proportionately contribute to the overall axial strength of the metal stud. For example, consider a standard 6-inch stud having 2-inch flanges and a ⅝" back or lip and a steel quality of 34 ksi. In such a design, the web extends straight across between the two flanges. A substantial portion of the web extending from the center outwardly towards the sides is ineffective. This, of course, means that the portions of the web adjacent the corners or flanges are more effective. As a general rule, the effectiveness of the stud design can be referred to as an effective width ratio. In the case of a conventional C-shaped metal stud, for purposes of reference and comparison, it is contemplated that the effective width ratio would be approximately 56%.

Turning to the metal stud shown in FIG. 2, note that the web of the stud is broken down into a series of sections or surfaces, 12A, 12B, 12C, 12D and 12E. Thus, the individual components or sections of the web have been shortened. As seen in FIG. 2, the respective sections are all disposed at an angle with respect to an adjacent section. This makes the entire web more effective. For a 6-inch stud having a steel quality of 33 ksi and a thickness of 33 mils, and conforming to the general design of FIG. 2, the effective width ratio is believed to be approximately 92%. By increasing the steel quality to 50 ksi and the thickness of the stud to 54 mils, the effective width ratio is believed to be increased to approximately 99.7%.

This can be compared to a 6-inch stud conforming to the basic design shown in FIG. 3 where the stud is of a 50 ksi quality and the thickness is 54 mils. The effective width ratio for this stud design is believed to be approximately 92%.

The particular overall dimensions of the metal stud 10 as well as its thickness may vary depending upon the loads to be carried, particularly the vertical loads. It is contemplated that in some applications, the thickness of the metal forming the stud would be in the range of 33 mils to 54 mils which would equate to a gauge range of 20 to 16. Further, it is contemplated that the angle of the diagonal sides 12A and 12B can be varied to address certain structural needs in certain applications. In any event, the metal stud 10 of the present invention is suitable for application in load bearing walls and because of the structural design of the stud itself, the stud is extremely efficient and has a relatively high strength to weight ratio.

Figure 4:
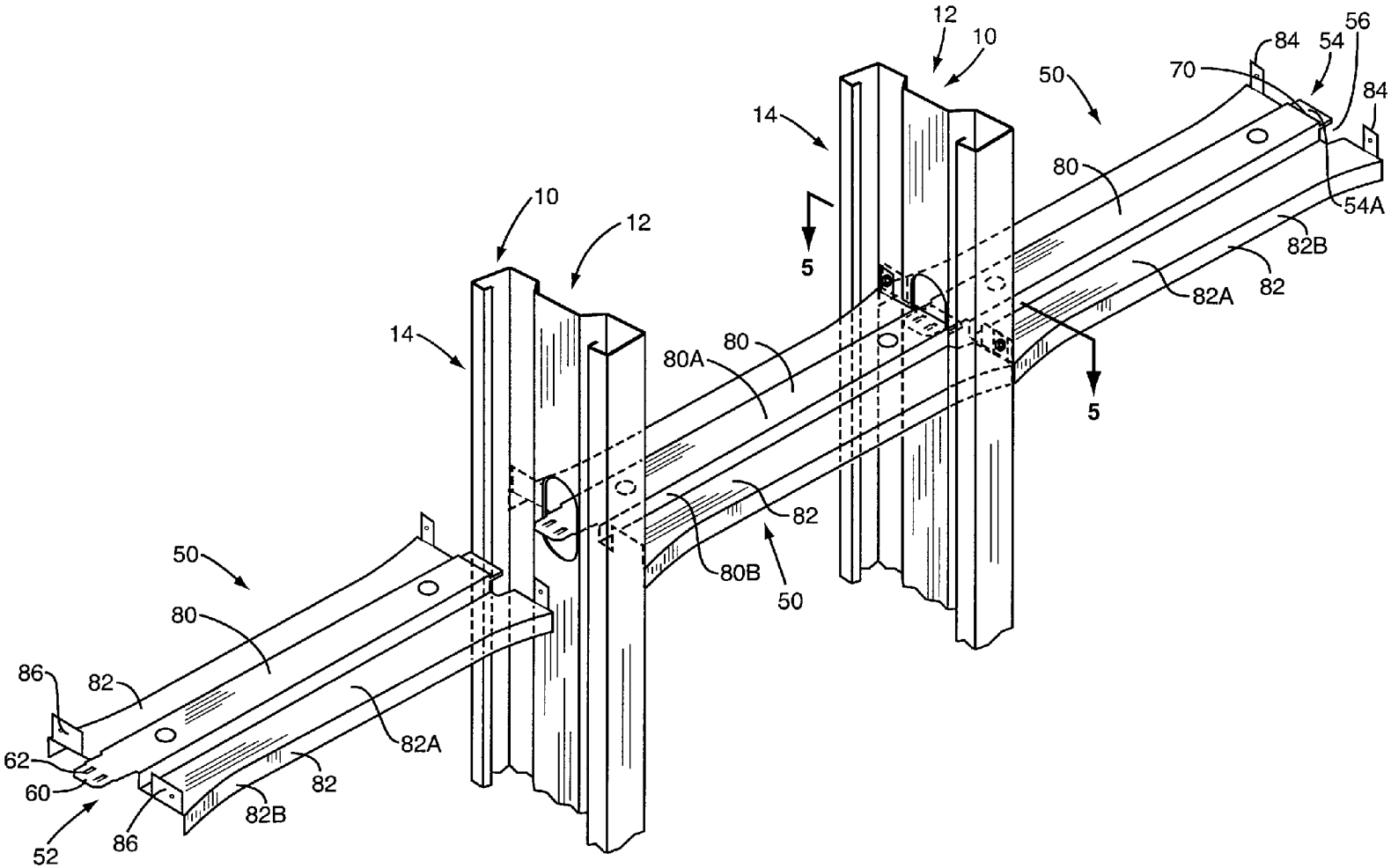
FIG. 4 is a perspective view showing a pair of metal studs and a series of bridging members.

Now turning to bridging member 50, as shown in the drawings the bridging member comprises a main member which has opposed end portions, sometimes referred to as herein as a first end portion and a second end portion. The main member of bridging member 50 comprises a central section 80 and a pair of side sections 82. In order to impart strength to the bridging member 50, the elevations of the central and side sections 80 and 82 vary. In the embodiment illustrated herein, central section 82 is raised with respect to side sections 82. Central sections 80 include a top 80A and a pair of opposed sides 80B. See FIG. 4. Note that sides 80B extend down to join the side sections 82. Side sections 82 in turn include a top 82A and downwardly projecting sides 82B. Sides 82B extend outwardly towards the end extremities of the bridging member 50. That is, sides 82B tend to flare or curve outwardly about the opposite end portions of the bridging member 50.

Figure 7:
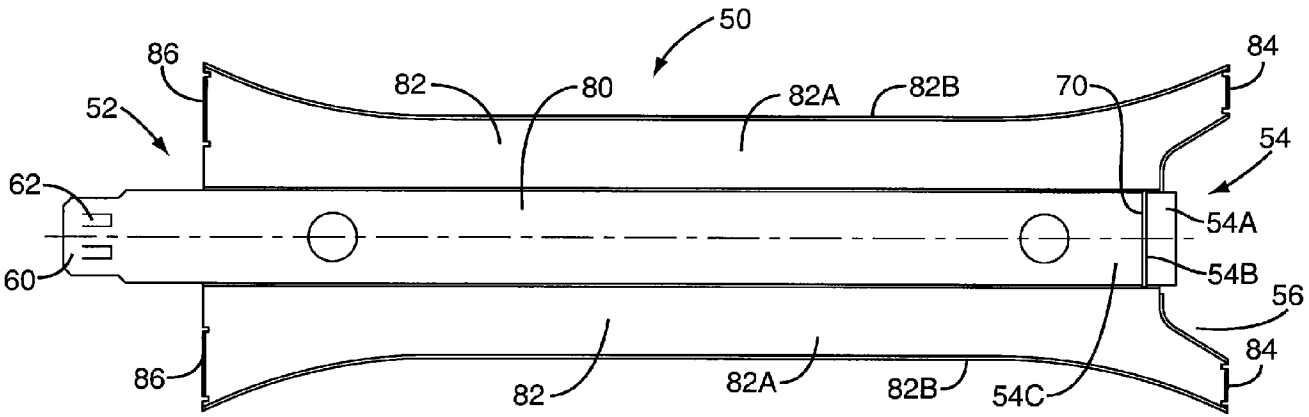
FIG. 7 is a top plan view of the bridging member.
Figure 6:
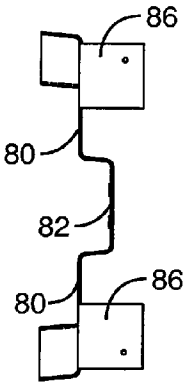
FIG. 6 is an end elevational view of one end portion of the bridging member.
Figure 9:
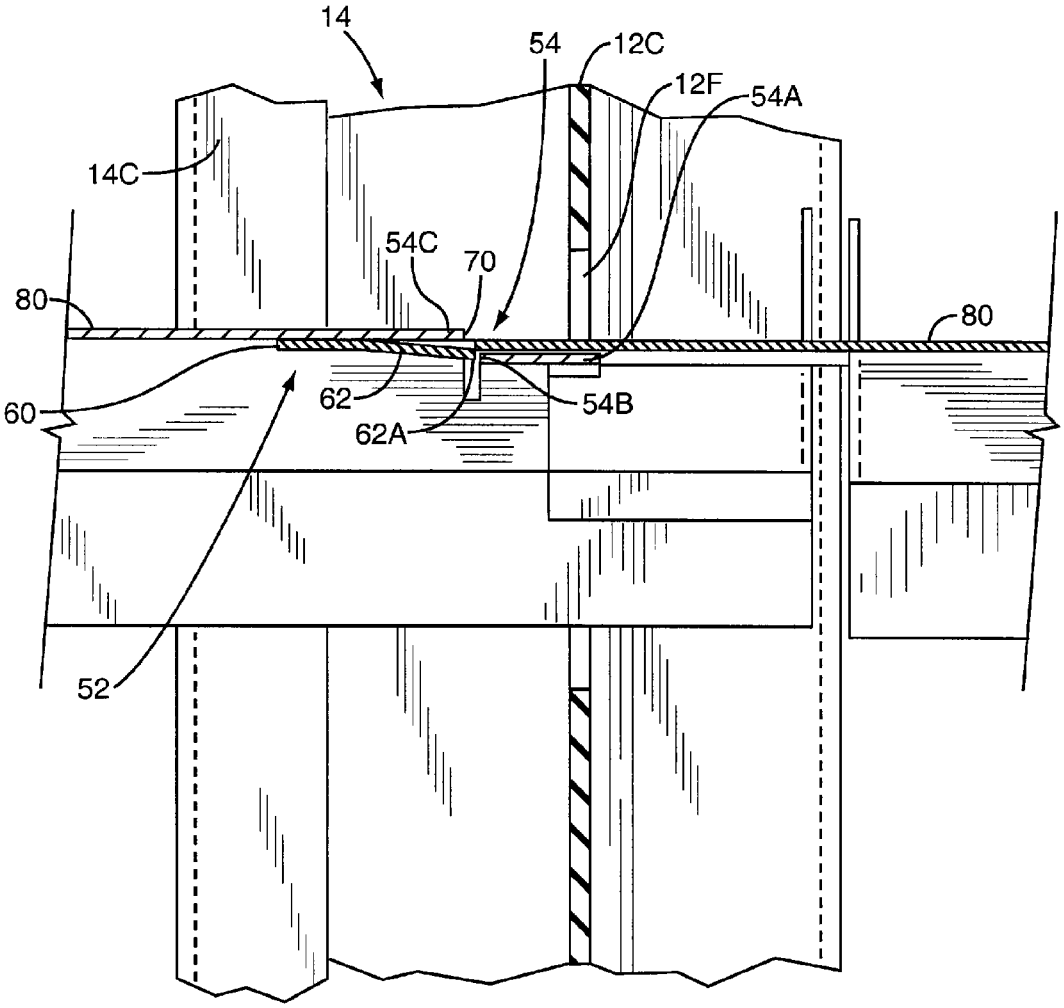
FIG. 9 is a sectional view taken through the line 9-9 of FIG. 8.

Disposed on first end portion of the bridging member 50 is a projection receiver indicated generally by the numeral 54. Disposed on the other end portion, that is the second end portion of the bridging member 50, is a projection indicated generally by the numeral 52. As will be discussed subsequently, when two bridging members 50 are connected in a wall structure, a projection 52 from one bridging member will project into and interlock with the projection receiver of another bridging member 50. Viewing the projection receiver 54 in more detail, it is seen that the same includes a transverse opening 70. This transverse opening 70 is formed, in the case of this embodiment, by a slight step in the central section 80. Note that the projection receiver includes a lower surface 54A and an upper surface 54B disposed on opposite sides of the opening 70. See FIGS. 7 and 9. A portion of the lower surface 54A includes an abutting edge surface 54B (FIG. 9).

Turning to the projection 54, disposed on the opposite end portion of the bridging member 50, the projection includes a tongue 60. Tongue 60 extends outwardly from the central section 80. Formed in the terminal end portion of the tongue 60 is a pair of locking tabs 62. Note in FIG. 9 where the locking tabs are partially cut from the tongue 60 and bent downwardly out of the plane of the tongue 60. That is, locking tabs 60 are cut on three sides and bent downwardly such that they have a deflecting quality. That is, the respective locking tabs 62 can be deflected upwardly towards the plane of the tongue 60. Further, each locking tab includes an abutting edge or surface 62A. As will be appreciated from subsequent portions of this disclosure, when the projection 52 is interlocked into a respective projection receiver 54, the edge 62A of the tab 62 aligns with the edge 54A of the receiver 54. That is, when the projection 52 is inserted into the opening 70 of the receiver 54, the tabs 62 will tend to deflect upwardly such that the tongue can be inserted into the opening 70. As the tongue 60 is pushed through the opening 70, the trailing ends of the tabs will eventually clear the opening 70. When cleared, the trailing ends of the tabs 60 will tend to spring downwardly to the position shown in FIG. 9. As seen in FIG. 9, when the tongue 60 is inserted into the opening 70, the trailing end or edges 62A of the tabs 62 will be partially aligned with the lower portion 54A of the receiver 54. More particularly, the edges 62A of the tab 62 will be at least partially aligned with the edge 54B of the receiver. Thus, when there is a force that tends to pull the two bridging members apart, the locking tabs 62, by engaging the edge 54B of the receiver 54, will tend to prevent the bridging members 50 from being pulled apart.

As seen in the drawings, the first end portion of the bridging member 50, that is that end portion that includes the projection receiver 54, includes a recess area 56 formed therein. See FIG. 7. Recess 56 is formed by the side sections 82 flaring outwardly and extending past the projection receiver 54. Recess 56 is formed to receive the depression 12 formed in the web of the stud 10. See FIG. 4. That is, when the bridging member 50 is placed adjacent the stud 10, the depression in the web will be oriented such that it projects into the recess 56.

Formed on the opposite end portions of the bridging member 50 are a series of tabs. With reference to the first end portion of the bridging member 50, there is provided a pair of tabs 84. Note that tabs 84 form the terminal end of the bridge member 50 about this particular end portion. That is, tabs 84 extend upwardly from the terminal ends of the side sections 82. In this particular case, tabs 84 are spaced such that they generally align with the portion of the web 12 outwardly of the depression. That is, when the bridging member is secured adjacent to stud 10, the tabs 84 rest adjacent or abut the portions 12D and 12E of the stud 10. See FIG. 5.

Figure 5:
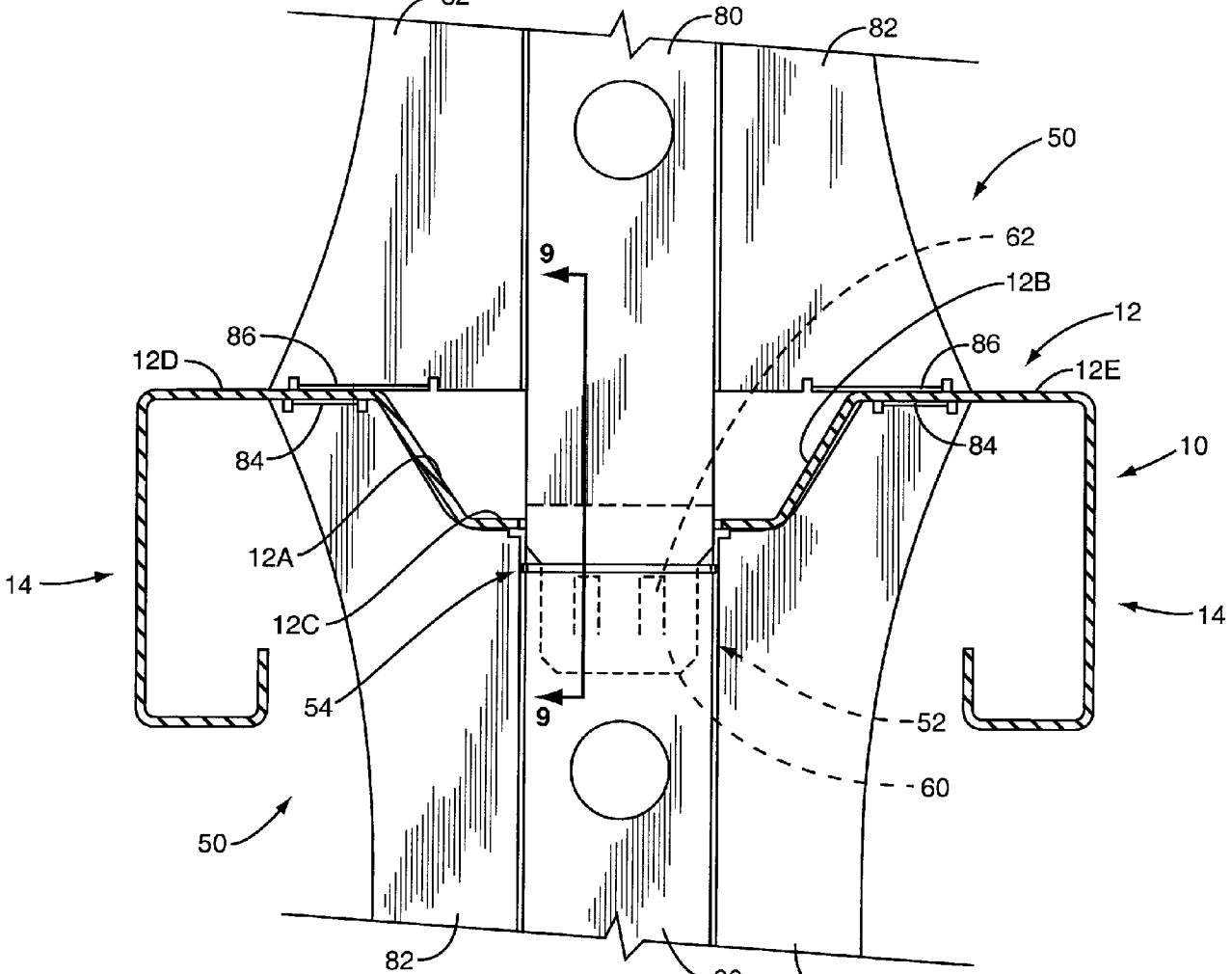
FIG. 5 is a sectional view taken along the line 5-5 of FIG. 4.
Figure 8:
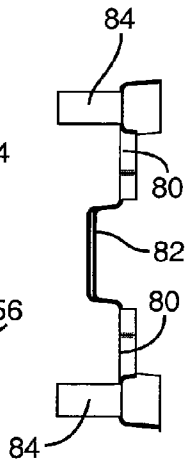
FIG. 8 is an end elevational view of the other end of the bridging member.

Secured or formed on the opposite end portion of the bridging member 50 is a pair of tabs 86. Tabs 86 are disposed inwardly of the terminal end of the tongue 60. Compared to tabs 84, tabs 86 are designed to rest adjacent or abut against the opposite side of the web 12. Again, this is shown in FIG. 5.

Tabs 84 and 86 can be provided with openings for receiving one or more screws that permit the tabs to be secured directly to the web 12 of the stud 10. Alternatively the tabs can be welded to the web. In addition, since the projections 52 are designed to be inserted into the receivers 54 and form an interlocked relationship, it is not necessary in all applications that the tabs 84 and 86 be actually fastened to the web 12 of each stud. In some cases the tabs 84 and 86 can simply rest adjacent the web or simply abut against the web.

From the foregoing discussions, it is seen that the stud 10 and bridging member 50 form a cooperative structure where the bridging member 50 is designed to be compatible with the stud 12, especially since the stud 12 includes a non-linear web. When utilized in a wall structure as shown in FIG. 10, the individual bridging members 50 extend between respective studs 10. The projections 52 project through the openings 12F in the studs 10 and into the projection receiver 54 where the projection interlocks therein. Thus, the bridging members 50 are interconnected end to end. As noted above, the bridging members 50 can be additionally connected to the respective studs 10.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A bridging member configured to interconnect first and second spaced apart structural members and also configured to connect to first and second like bridging members, the bridging member comprising:

a. a main member;

b. the main member having a first end and a second end;

c. a projection receiver disposed on the main member adjacent the first end of the main member;

d. a projection extending from the main member and projecting outwardly past the second end of the main member;

e. the projection configured to project into and interconnect and lock with the projection receiver of the first like bridging member;

f. the projection receiver configured to receive and interconnect and lock with a projection of the second like bridging member;

g. a first set of spaced apart tabs disposed on the first end of the bridging member for connecting to one of the structural members, the first set of tabs being disposed at an angle with respect to the bridging member and configured to lie adjacent the first structural member such that the tabs can be connected to the first structural member;

h. a second set of spaced apart tabs disposed on the second end of the bridging member for connecting to the second structural member, the second set of tabs being disposed at an angle with respect to the main member and configured to lie adjacent the second structural member such that the tabs can be connected to the second structural member;

i. the projection extending outwardly past the second set of tabs;

j. wherein the bridging member further includes:

i. a concave recess formed in the main member adjacent the first end of the main member;

ii. the recess extending inwardly from the first set of tabs;

iii. wherein the recess forms in the main member a pair of spaced apart portions that at least partially bound the recess;

iv. wherein the first set of tabs extend at an angle from the spaced apart portions that at least partially bound the recess;

v. wherein the projection receiver is spaced adjacent the recess but inwardly of the first set of tabs;

vi. wherein the spaced apart portions formed by the recess extend at least slightly outwardly with respect to a longitudinal axis of the main member; and vii. wherein each of the tabs is turned at an angle with respect to the main member and wherein each tab extends in a transverse vertical plane with respect to the main member.

2. The bridging member of claim 1 wherein the projection receiver includes an elongated slot formed between two surfaces of the main member disposed at different elevations.

3. The bridging member of claim 2 wherein the projection includes one or more locking tabs that extends into and locks with the projection receiver of the first bridging member.

4. The bridging member of claim 3 wherein the one or more locking tabs are cut from the projection and are bent away from a surface forming a part of the projection and wherein the one or more locking tabs are configured to interconnect with and lock in the projection receiver of the first like bridging member.

5. The bridging member of claim 1 wherein the projection receiver includes an elongated slot formed between two stepped surfaces of the main member disposed at different elevations; and wherein the projection includes one or more locking tabs that lock with the projection receiver of the first like bridging member.

6. The bridging member of claim 1 wherein the projection receiver includes an elongated slot formed between two surfaces of the main member and disposed at different elevations.

7. The bridging member of claim 1 wherein the main member includes an elongated raised central section that extends between the first and second ends, and a pair of side sections disposed on opposite sides of the central section and stepped down with respect to the central section and extending between the first and second ends.

8. The bridging member of claim 1 wherein the projection includes at least one locking tab cut from the projection and bent at least partially out of the plane of the projection, the locking tab including a terminal end.

9. The bridging member of claim 8 wherein the projection receiver includes an elongated slot extending transversely across at least a portion of the main member and a locking edge.

10. The bridging member of claim 1 wherein the projection is generally flat and extends generally straight from the first end of the main member and wherein the projection receiver includes a transverse slot that extends generally normal relative to a longitudinal axis of the main member.

* * * * *